United States Patent [19]

Retzloff

[11] Patent Number: 4,874,158

[45] Date of Patent: Oct. 17, 1989

[54] DISPENSING FOLD IMPROVEMENT FOR A CLIP SEPARATOR

[75] Inventor: Timm G. Retzloff, Washburn, Wis.

[73] Assignee: C. G. Bretting Manufacturing Co., Inc., Ashland, Wis.

[21] Appl. No.: 209,220

[22] Filed: Jun. 20, 1988

[51] Int. Cl.[4] ..... B41L 1/32

[52] U.S. Cl. ..... 270/39; 493/40

[58] Field of Search ..... 270/32, 39, 40, 41, 270/42, 55, 57, 58, 21.1, 52.5; 493/409–412, 416–417, 429–430

[56] References Cited

U.S. PATENT DOCUMENTS

| | | | |
|---|---|---|---|
| 3,207,361 | 9/1965 | Marcalus | 270/39 |
| 4,070,014 | 1/1978 | Takahashi | 270/39 |
| 4,700,939 | 10/1987 | Hathaway | 270/39 |
| 4,717,135 | 1/1988 | Hathaway | 270/39 |
| 4,721,295 | 1/1988 | Hathaway | 270/39 |
| 4,770,402 | 9/1988 | Couturier | 270/39 |
| 4,824,426 | 4/1989 | DuFresne | 270/39 |

FOREIGN PATENT DOCUMENTS

| | | | |
|---|---|---|---|
| 219396 | 6/1961 | Austria | 270/39 |
| 1479299 | 7/1977 | United Kingdom | 270/39 |

*Primary Examiner*—Robert E. Garrett
*Assistant Examiner*—Therese M. Newholm
*Attorney, Agent, or Firm*—Faegre & Benson

[57] ABSTRACT

Method and apparatus for forming a dispensing fold for a clip or predetermined number of interfolded sheets from a continuously building interfolding process having first and second opposed dispensing fold fingers operable between actuated and deactutated positions to engage a mediate portion of a depending layer of the bottommost sheet from the interfolding process stack to form a dispensing fold.

14 Claims, 13 Drawing Sheets

DISPENSING FOLD IMPROVEMENT FOR A CLIP SEPARATOR

FIELD OF THE INVENTION

This invention relates to an improvement for an automatic separator for separating predetermined quantities of items such as paper napkins, towels, or similar items into a stack or clip wherein the first sheet is folded over to aid withdrawal of the first sheet from a carton or package containing the clip.

DETAILED DESCRIPTION OF THE DRAWINGS

Figure 1:
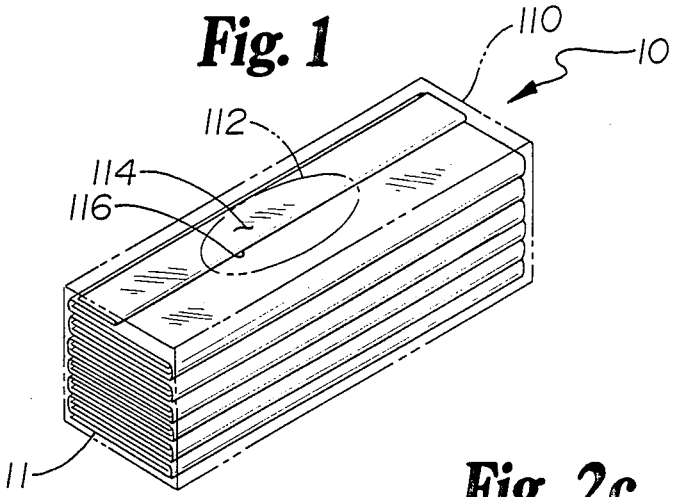
FIG. 1 is a pictorial drawing of a clip of folded, interlayered facial tissues having a top layer formed into a dispensing fold with a surrounding package shown in phantom.

FIG. 1 shows a clip 10 formed from a stack of interfolded laminar products or items 11 such as paper napkins, towels, or facial tissues. A carton or package 110 for clip 10 is shown in phantom. Carton 110 has an opening 112 to permit a consumer to reach inside, grasp and withdraw a tissue 114 from carton 110. It may be observed that without a seam or crease 116 accessible to the consumer, withdrawing the first tissue 114 will be more difficult. This invention is an apparatus and method for forming a dispensing fold or crease 116 in tissue 114 as an improvement to the clip separator of U.S. Pat. No. 4,770,402, application Ser. No. 040,546 filed Apr. 17, 1987.

In a preferred practice of this invention, the bottom sheet is folded over and inverted cartons are loaded with the dispensing fold on the bottom of the clip. The carton bottom panel is closed and sealed, and the carton turned upright for purchase and use by a consumer.

Figure 1A:
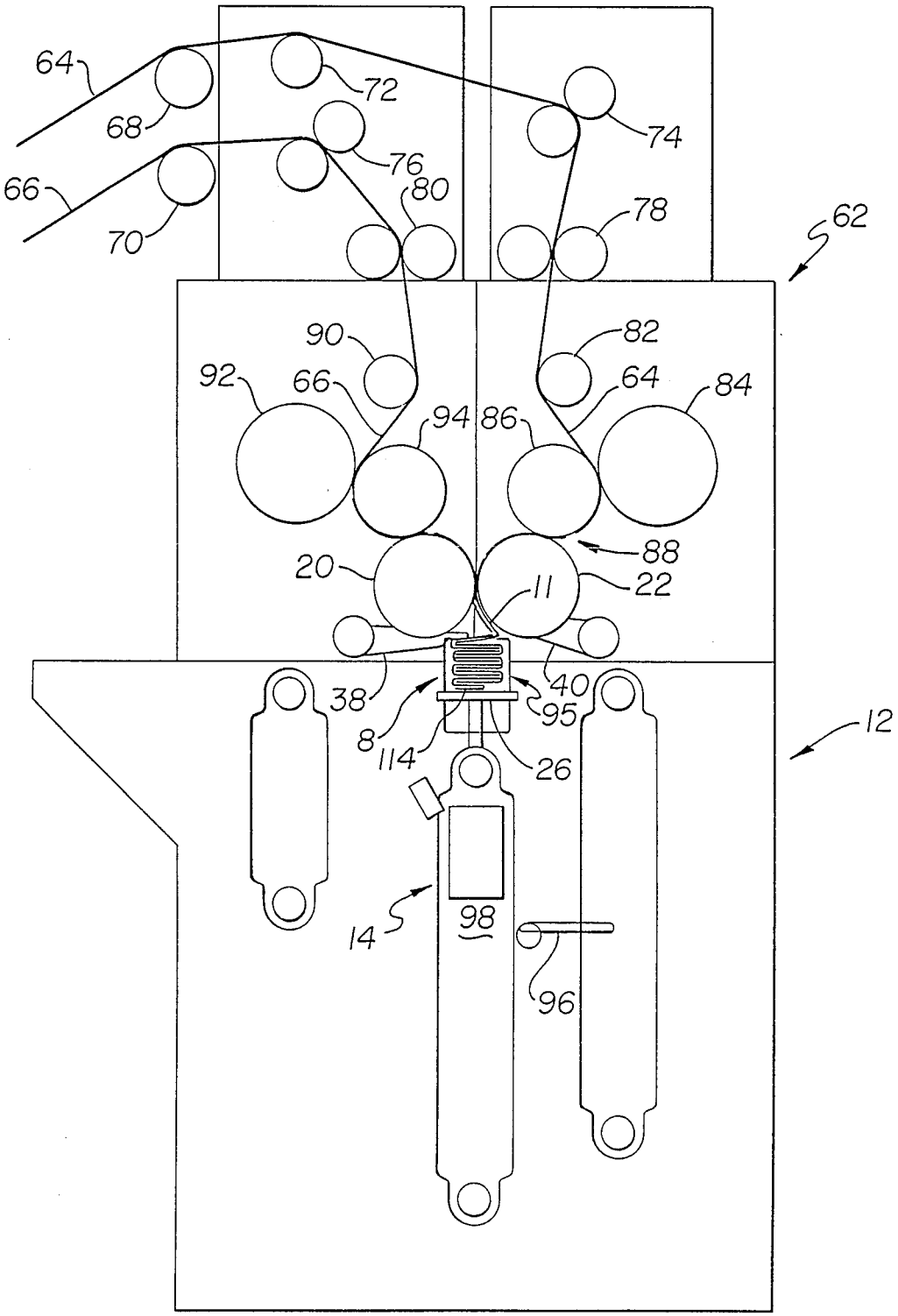
FIG. 1*a* is a simplified right side elevation view of a web cutting and folding and clip separating machine.

FIG. 1*a* shows a simplified view of the machine environment of this dispensing fold improvement. Machine 62 receives two continuous webs or sheets 64, 66 and processes them by slitting longitudinally, cutting transversely, interfolding the cut-web sheets and stacking them in a continuous fashion.

Webs 64, 66 pass over spreader rolls 68, 70 which may be conventional Mount Hope-type rolls. Web 64 then passes over idler roll 72. Webs 64, 66 then pass through slitter roll pairs 74, 76 and folder feed roll pairs 78, 80. After passing over idler roll 82, web 64, passes between cutoff roll 84 and cutoff bedroll 86 where it is severed transversely (indicated by gaps 88 in web 64). Similarly web 66 passes over rolls 90–94. Webs 64, 66 are then transferred respectively to folding rolls 22, 20.

Folding rolls 22, 20 interfold severed webs 64, 66 and release the interfolded severed webs or cut sheets 11 to be built into a stack 8 on a table 26 by a pair of packer fingers 40, 38.

An automatic separator 12 is located in the lower portion of machine 62 and periodically separates a clip 10 of a predetermined number of sheets 11 from the continuously building stack 8 on an interfolding table 26 carrying clip 10 to a separator outlet position 98 adjacent a reject gate 96.

Figure 2:
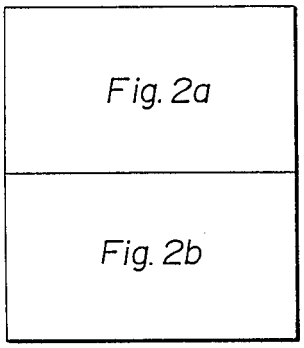
FIG. 2 is a multiple sheet organization diagram on the orientation of FIGS. 2*a* and 2*b*.
Figure 2C:
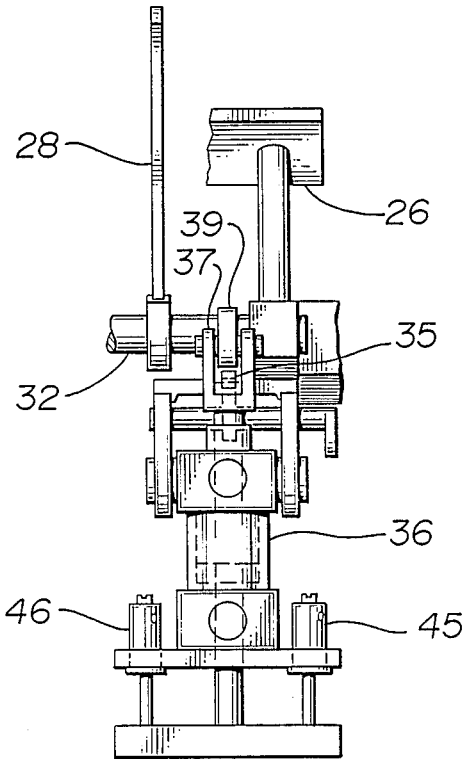
FIG. 2*c* is a rear elevation view taken along line 2*c*–2*c* of FIG. 5.
Figure 2A:
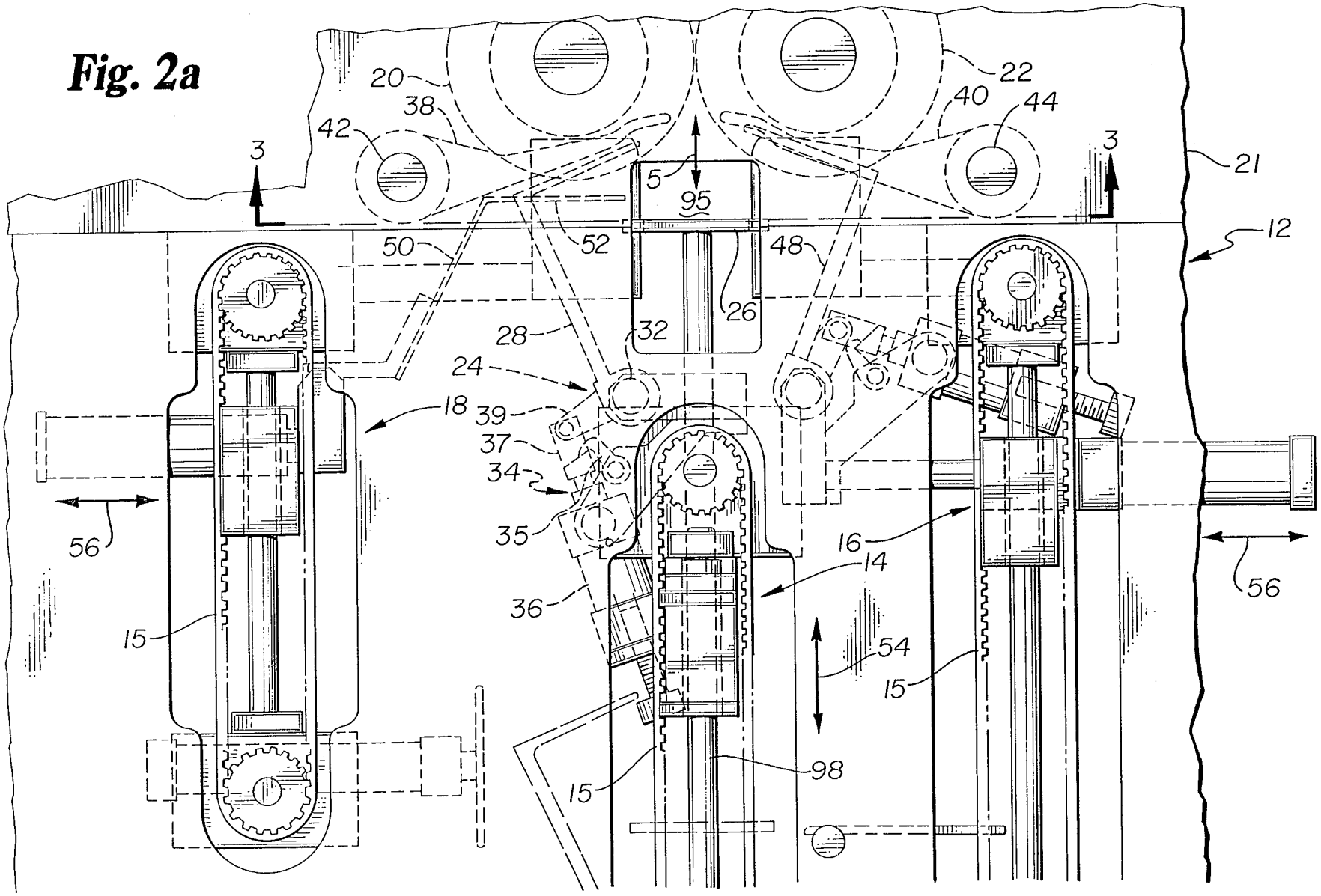
FIG. 2*a* is a fragmentary right side elevation view of the clip separator portion of the machine of FIG. 1*a*.
Figure 2B:
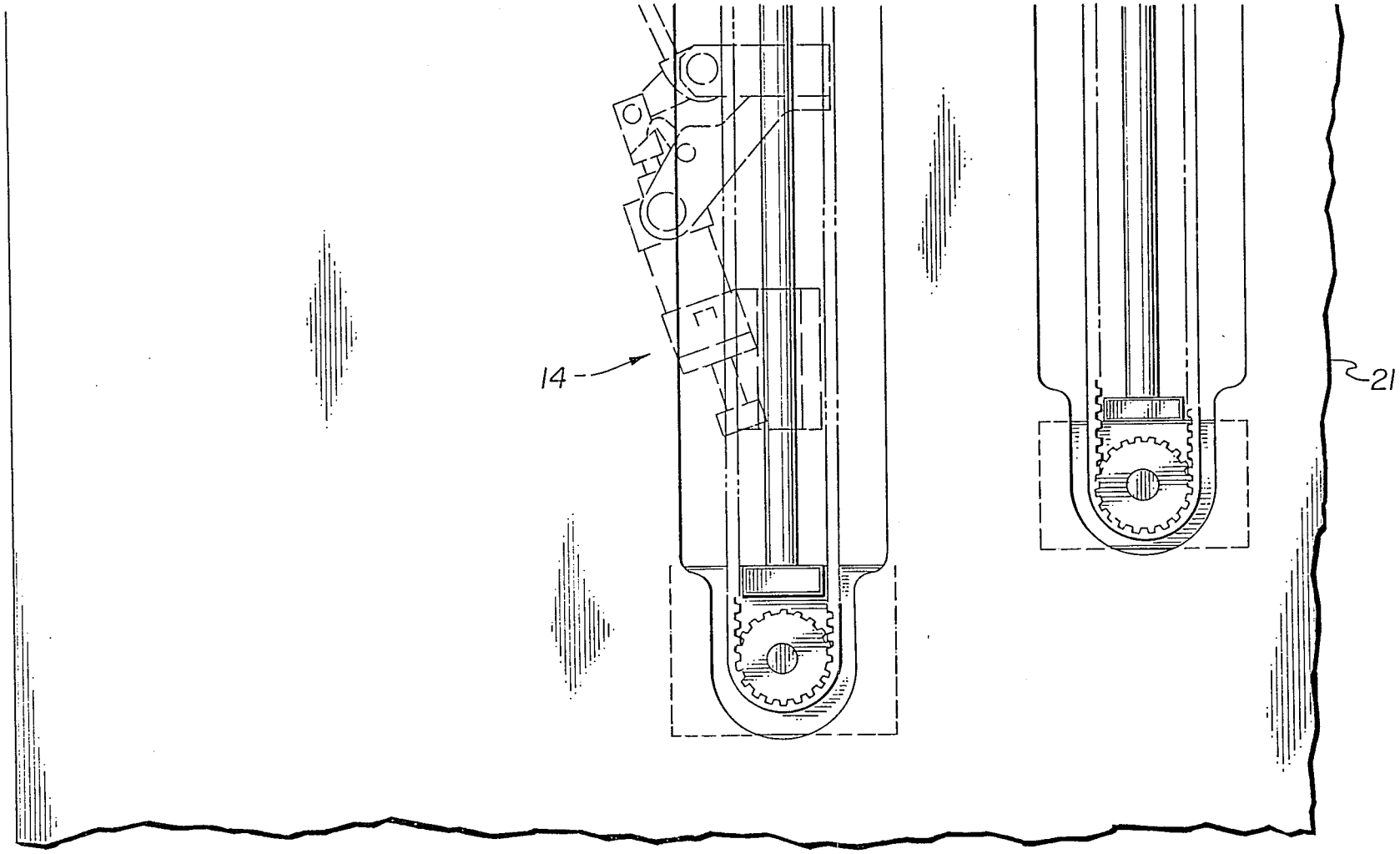
FIG. 2*b* is a fragmentary right side elevation view of a portion of the machine adjoining FIG. 2*a*.

Automatic separator 12 is shown in more detail in FIGS. 2*a*–2*b* and in various positions during a clip separation cycle in FIGS. 5–11. A stack principal axis 5 represents the direction along which stack 8 is built. Separator 12 has three moveable carriages 14, 16, 18. The center carriage is the first count finger/interfolding table carriage 14 and is located directly below the folding rolls 20, 22 at a package building station 95 and is movable along the stack principal axis 5. As will be later described in greater detail, carriages 14–18 operate to separate interfolded sheets 11 into a succession of clips 10 each having a predetermined number of sheets 11 with the bottom sheet 114 formed with a dispensing fold. As a part of this process, carriage 14 moves the separated clip 10 from the folding rolls 20, 22 to the separator outlet position 98 for further processing. Such further processing may include orienting and shaping clip 10 prior to inserting clip 10 into a carton 110 or other package. A first count finger assembly or retention means 24 and interfolding or elevator table 26 are mounted on carriage 14. Carriages 14, 16 and 18 are movable by positive drive belts 15 and motors (not shown) or other drive means which allow controlled positioning.

Figure 3:
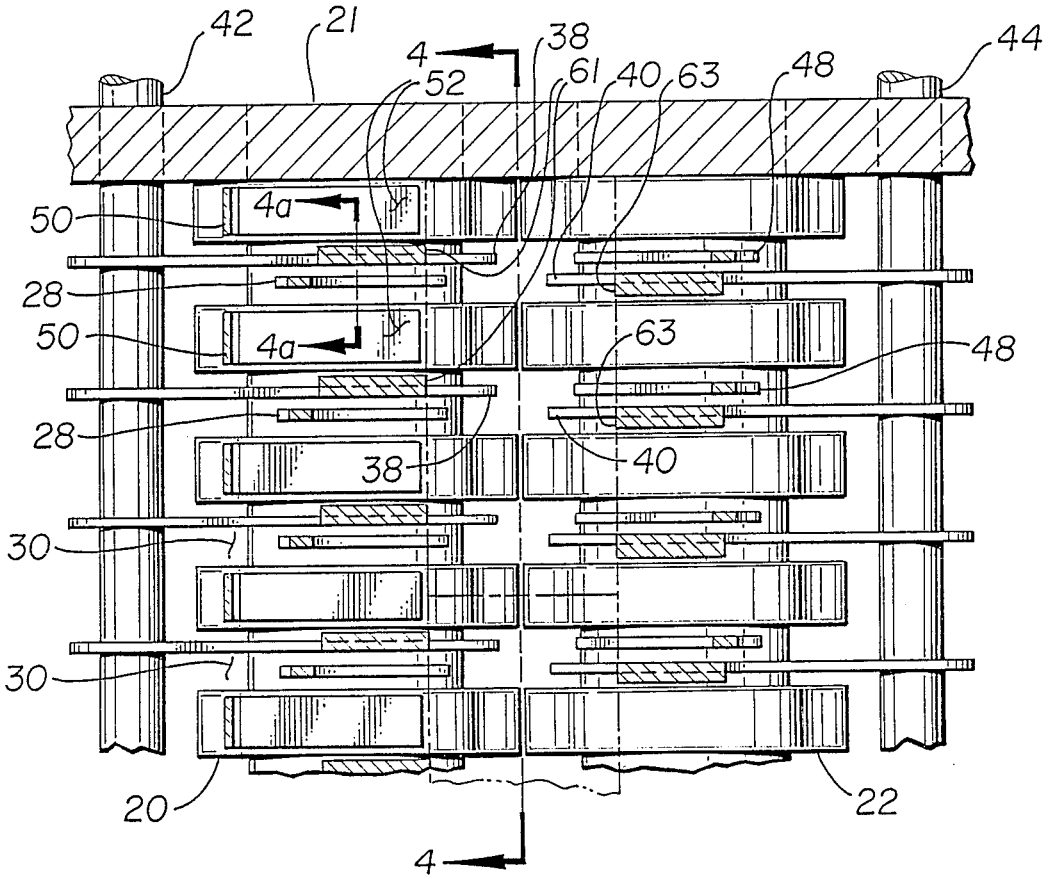
FIG. 3 is a bottom plan view of a portion of the machine shown in FIG. 2*a*.
Figure 4:
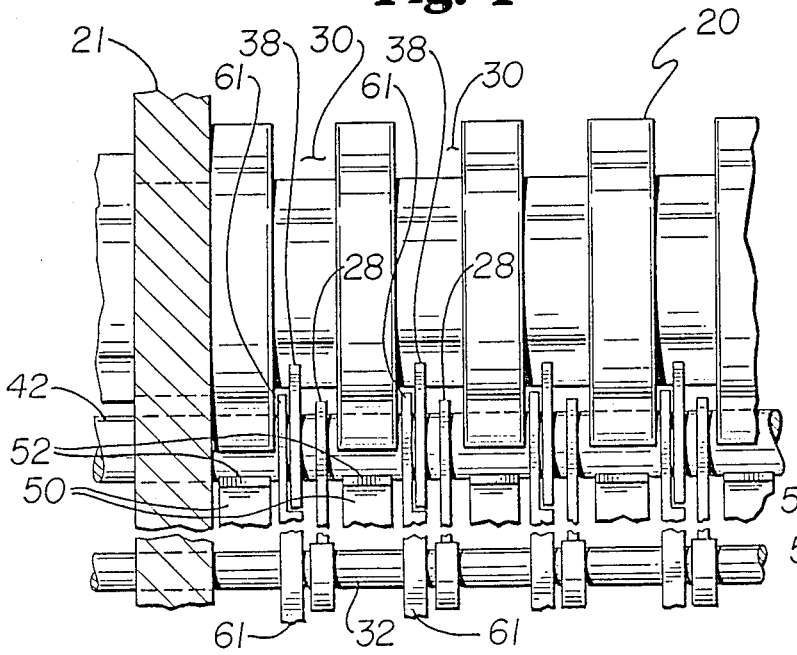
FIG. 4 is a front elevation section view taken along line 4—4 of FIG. 3.
Figure 4A:
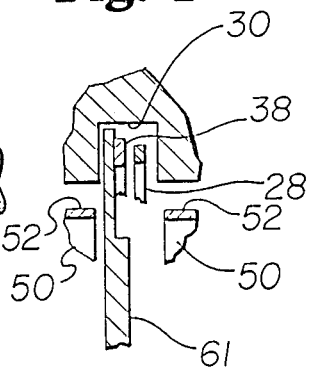
FIG. 4*a* is a fragmentary elevation section view taken along line 4*a*–4*a* of FIG. 4.
Figure 5:
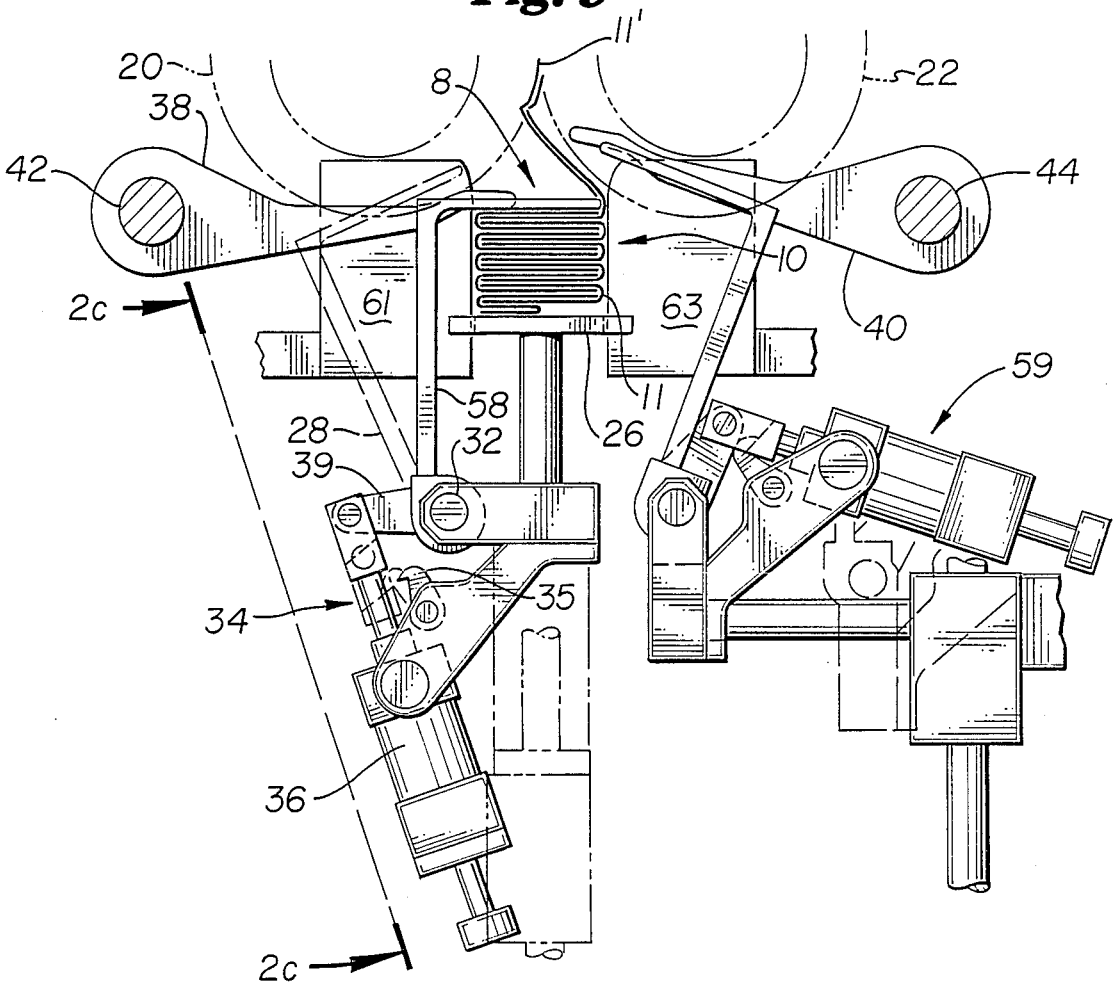
FIG. 5 is a simplified right side elevation view of elements of the machine of FIG. 1*a* and 2*a* at the beginning of a clip separation cycle where the first count fingers are actuated.

As may be seen in FIGS. 3, 4 and 5, a plurality of first or initial count fingers 28 are transversely aligned with radial grooves 30 in folding roll 20 which itself is mounted for rotation in machine frame 21. First count fingers 28 are mounted to a pivoting shaft 32 to which a torque is applied by an actuator 36 which may be a mechanical spring or pre loaded air cylinder. Shaft 32 is prevented from moving in response to the applied torque by mechanical latch 34.

A plurality of first and second packer fingers 38, 40 are mounted on first and second packer finger shafts 42, 44 respectively and operate in a conventional manner to build stack 8 as may be seen in FIGS. 3–7. A plurality of stationary guides 61, 63 serve to align successive layers 11 as they are built into stack 8 along stack principal axis 5.

Referring now also to FIG. 2*c*, at a desired time (after a predetermined number of sheets 11 have been interfolded into stack 8 and between folds when first packer fingers 38 are actuated as in FIG. 5) hook 35 of latch 34 is released and the actuator 36 operates through clevis 37 and link 39 to move count fingers 28 toward table 26 in a pivoting motion which ends in a controlled deceleration to avoid shock or impact loading of fingers 28. The controlled deceleration is accomplished by hydraulic shock absorbers 45, 46 operating mechanically in parallel with actuator 36 at the end of pivoting motion of fingers 28 as they come to rest in an actuated position 58 so as to retain clip 10 (as shown in FIG. 5).

Carriage 16 includes a plurality of pivoting second or platform count fingers 48 controlled by a latch and actuator mechanism 59 similar to that which operates first count fingers 28.

Carriage 18 carries a plurality of package build fingers 50, each of which has a relatively flat end portion 52.

Each of carriages 14, 16, 18 is capable of controlled movement in the "Y" or package build direction 54 Direction 54 is parallel to the stack principal axis 5. In addition, carriages 16 and 18 are also capable of controlled movement in the "X" direction 56 for clearance purposes as will be described in more detail. Although direction 54 is shown to be vertical and direction 56 is shown to be horizontal, it is to be considered within the scope of this invention that these directions are not limited to vertical and horizontal, respectively, and are utilized merely to aid in understanding the operation of this invention. As a further aid in describing this invention, upward movement along direction 54 and rightward movement along direction 56 will be considered positive, while downward and leftward movement will be considered negative.

The operation of separator 12 is as follows. Cut web interfolding is performed continuously by folding rolls 20, 22 cooperating with first and second packer fingers 38, 40 forming or building stack 8 on table 26. In FIG. 5, stack 8 which will be become separated as clip 10 is shown at the beginning of a separation cycle. Once a predetermined number of sheets 11 have been built into stack 8 by folding rolls 20, 22 and packer fingers 38, 40 between guides 61, 63 on table 26, latch 34 releases first count fingers 28. First count fingers 28 then come to rest in an actuated position 58. Clip 10 is now held between count fingers 28 in position 58 and table 26. It is to be understood that folding rolls 20, 22 and packer fingers 38, 40 continue uninterrupted operation throughout the clip separation cycle.

Figure 6:
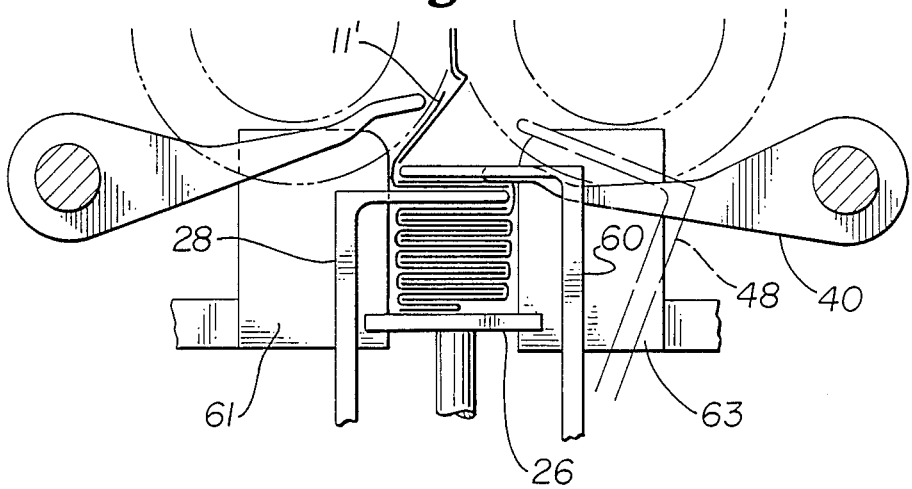
FIG. 6 illustrates elements of the machine just past the beginning of the clip separation cycle where the second count fingers are actuated.

Referring now to FIG. 6, second or platform count fingers 48 are actuated from a ready position away from the stack principal axis one fold after actuation of the first count fingers, when second packer fingers are actuated. Second count fingers move transversely (in an arc) toward the stack principal axis 5 and come to rest in an actuated position 60.

Figure 7:
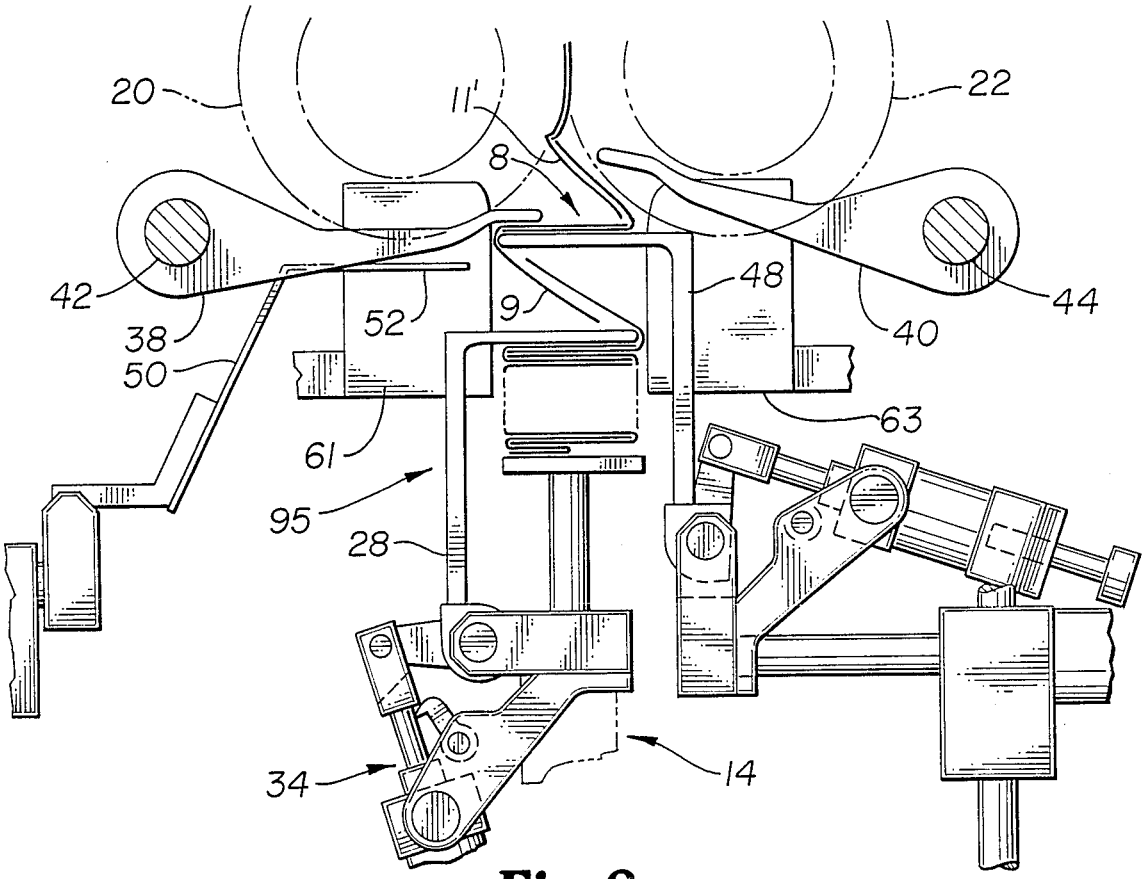
FIG. 7 illustrates elements of the machine at a position later in the cycle where a completed clip is being separated from the continuously building stack.

As may be seen most clearly in FIG. 7, second count fingers 48 in actuated position 60 provide a platform count finger or stack supporting means to support continued building of succeeding sheets or laminar products 11' into stack 8 at a package building station or position 95. Platform count fingers 48 are thus selectively interposable above table 26, preferably after a fixed or predetermined number of sheets or laminar products 11' have been interfolded into stack 8.

Figure 8:
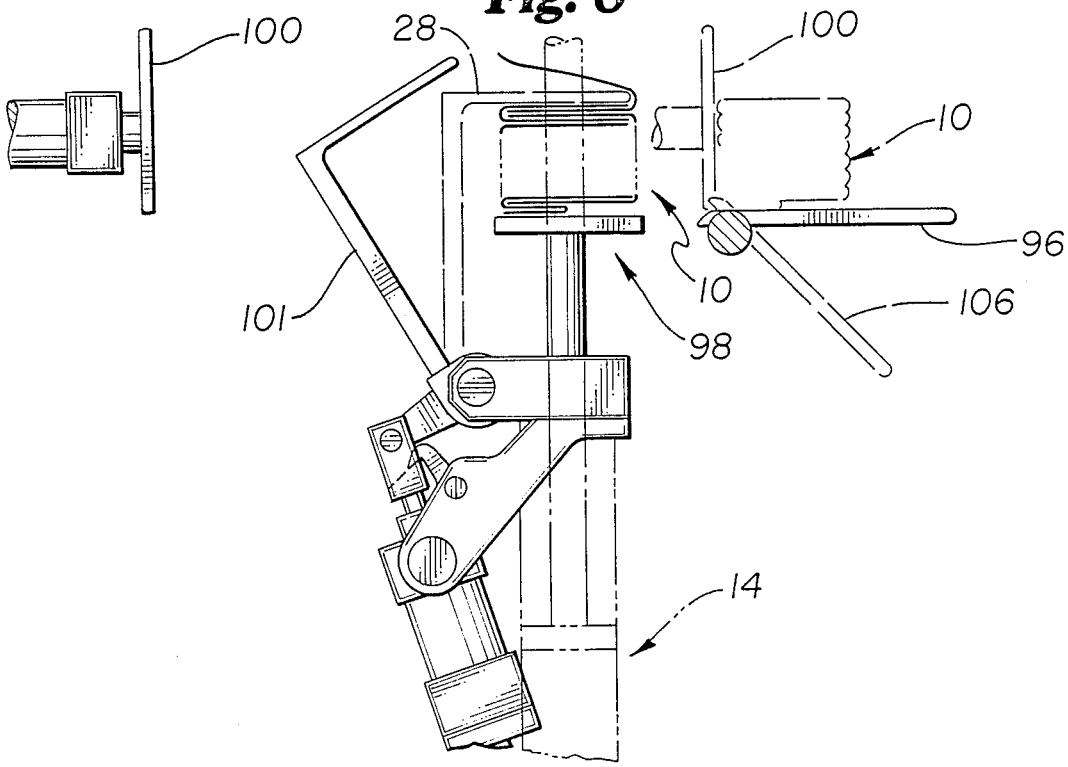
FIG. 8 illustrates elements of the machine still further in the cycle where the separated clip is transferred out of the separator.

As successive sheets 11' are building, separated clip 10 is rapidly moved away from the folding rolls 20, 22 by carriage 14 moving in the −Y direction. It is to be understood that the rate of this motion is preferably substantially greater than the stack build rate motion. At this time, second count finger carriage 16 is continuously moved downward at a gradual rate corresponding to the build rate of successive clip 10' such that each successive top sheet 11' of stack 8 is properly positioned by packer fingers 38, 40. Carriage 14 moves clip 10 from the package build station or position 95 to the separator outlet station or position 98 (as shown in FIG. 8. Carriage 14 is shown at station 95 in FIG. 2*a* and at station 98 in FIG. 2*b*. Retention fingers 28 hold clip 10 to table 26 as carriage 14 moves from position 95 (shown in FIG. 7) to position 98 (shown in FIG. 8).

Figure 7A:
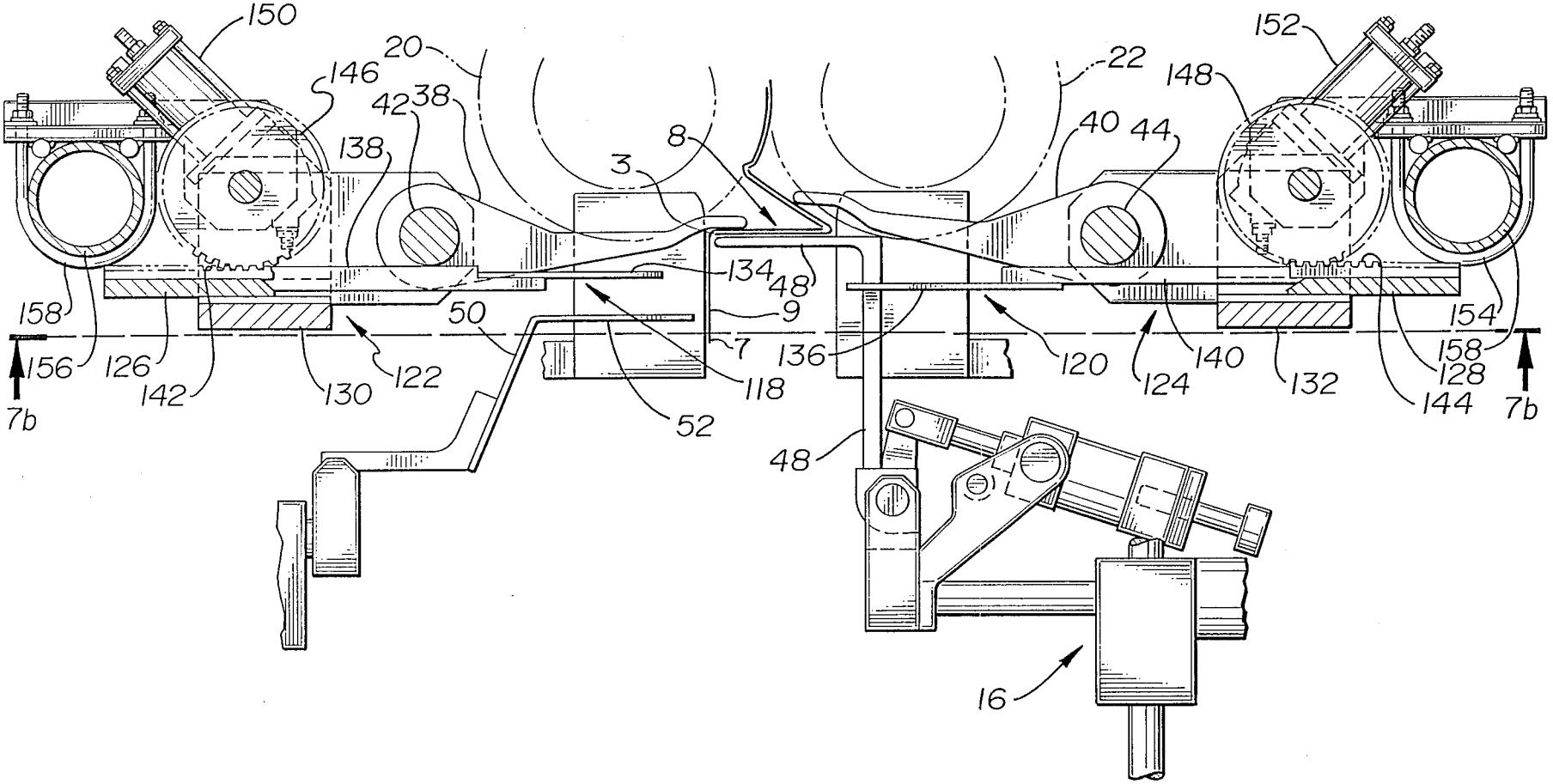
FIG. 7*a* illustrates elements of the machine at a position still later in the cycle where the completed clip is separated and a new clip is shown just prior to forming a dispensing fold.

After clip 10 is moved away from the package build station 95, loose end sheet portion or depending layer 9 is hanging or depending freely from the bottom of the stack below the second count fingers or stack supporting means 48. At this time, first and second dispensing fold fingers 118, 120 are in their retracted or deactuated positions 122, 124, clear of the interfolding process stack 8 and depending layer 9 as shown in FIG. 7*a*. Fingers 118, 120 are respectively supported on finger mounts 126, 128 for sliding movement relative to first and second cross members 130, 132. Fingers 118, 120 are thus each movable perpendicularly to the stack principal axis 5. It is to be understood that the first and second dispensing fold fingers 118, 120 are longitudinally offset from each other along the stack principal axis 5. As may be seen in FIG. 7*c*, first dispensing fold finger 118 is intermediate the horizontal portion of stack supporting means 48 and the second dispensing fold finger 120 when fingers 118, 120 are in their respective actuated positions 164, 170.

Figure 7B:
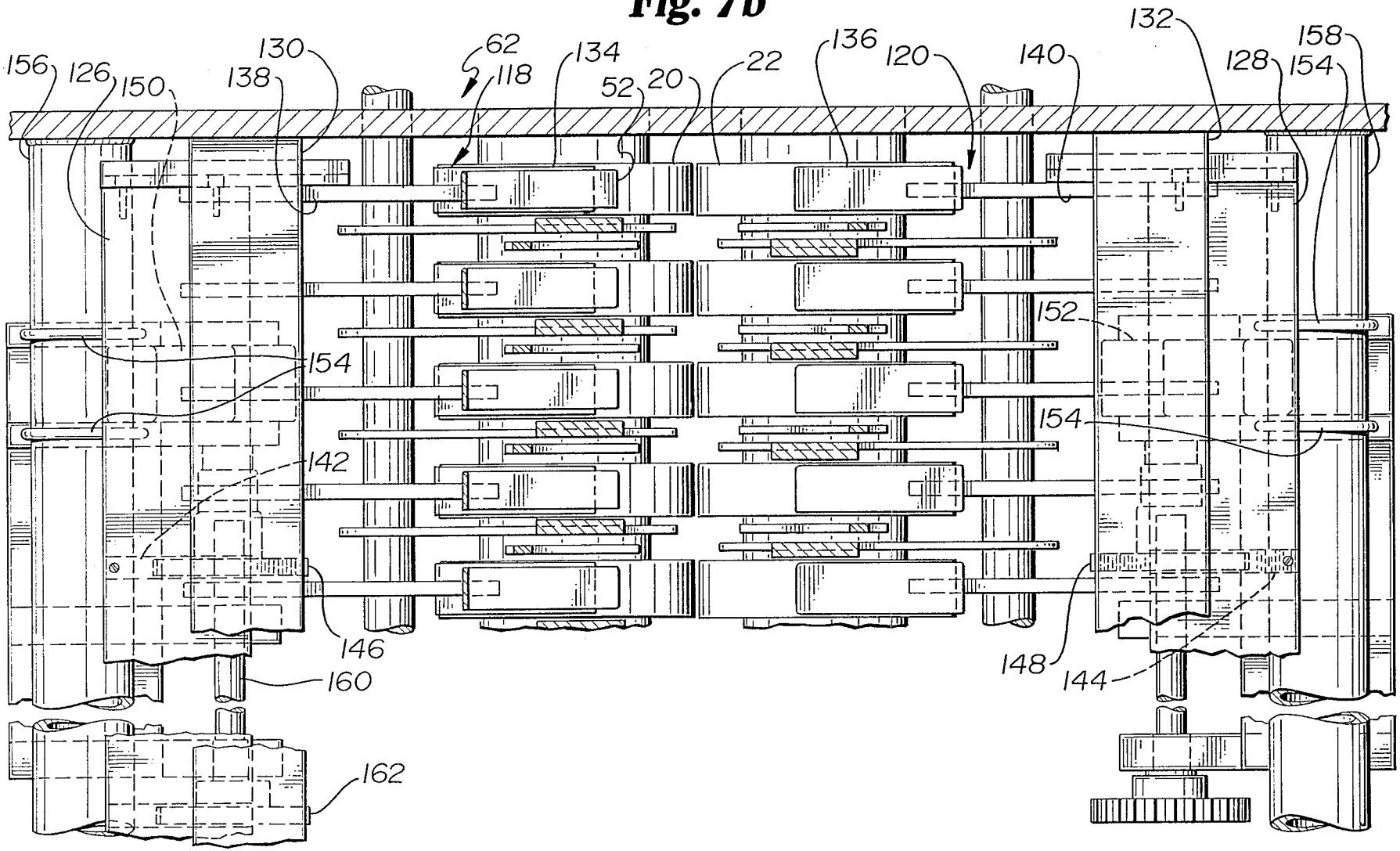
FIG. 7*b* is a bottom view along line 7*b*–7*b* of FIG. 7*a*, but omitting the interfolded products for clarity.
Figures 7C, 7E:
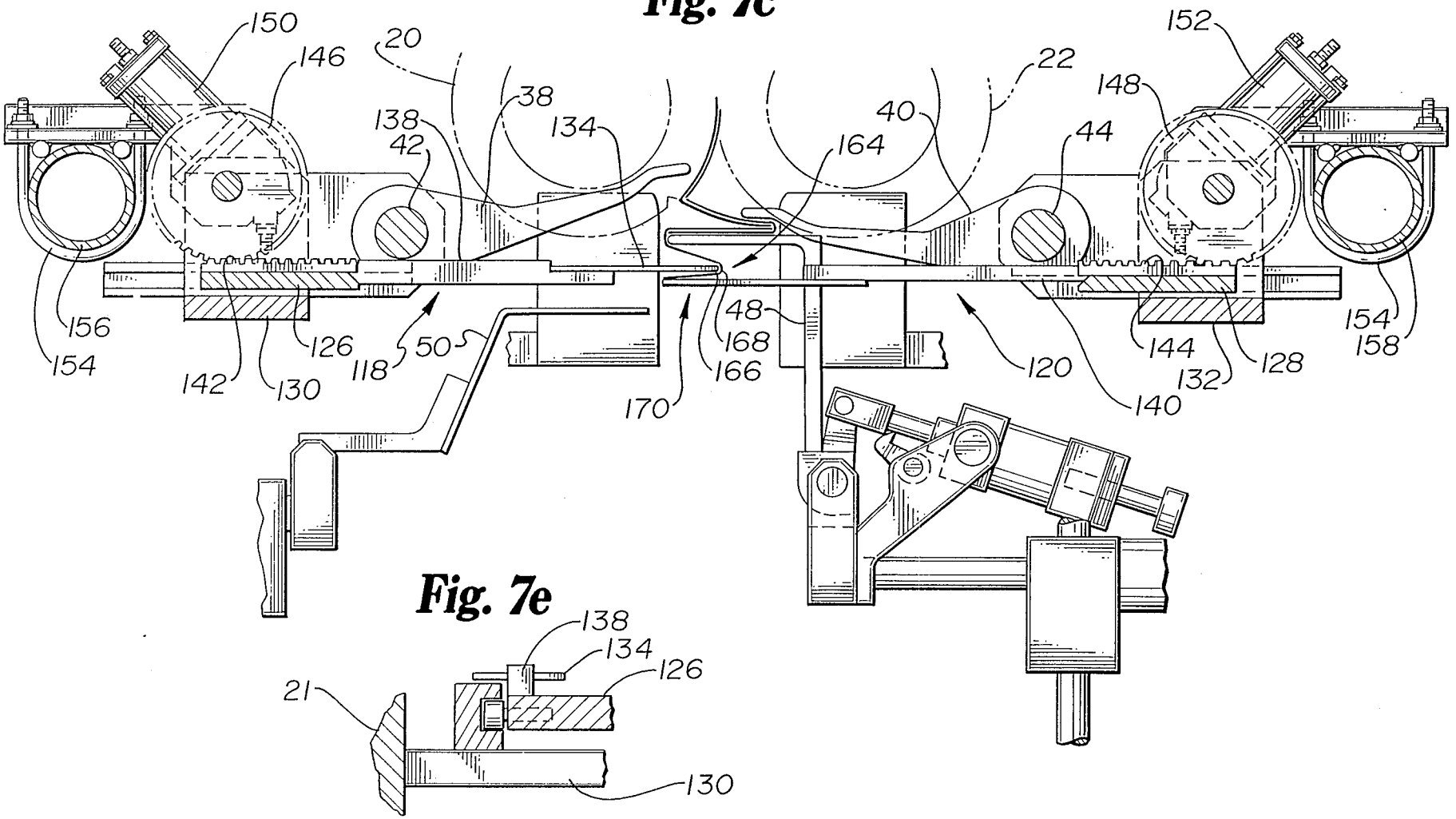
FIG. 7*c* illustrates elements of the machine advanced to a position forming a dispensing fold.
FIG. 7*e* is a fragmentary view taken along line 7*e*–7*e* of FIG. 7*d*.
Figure 7D:
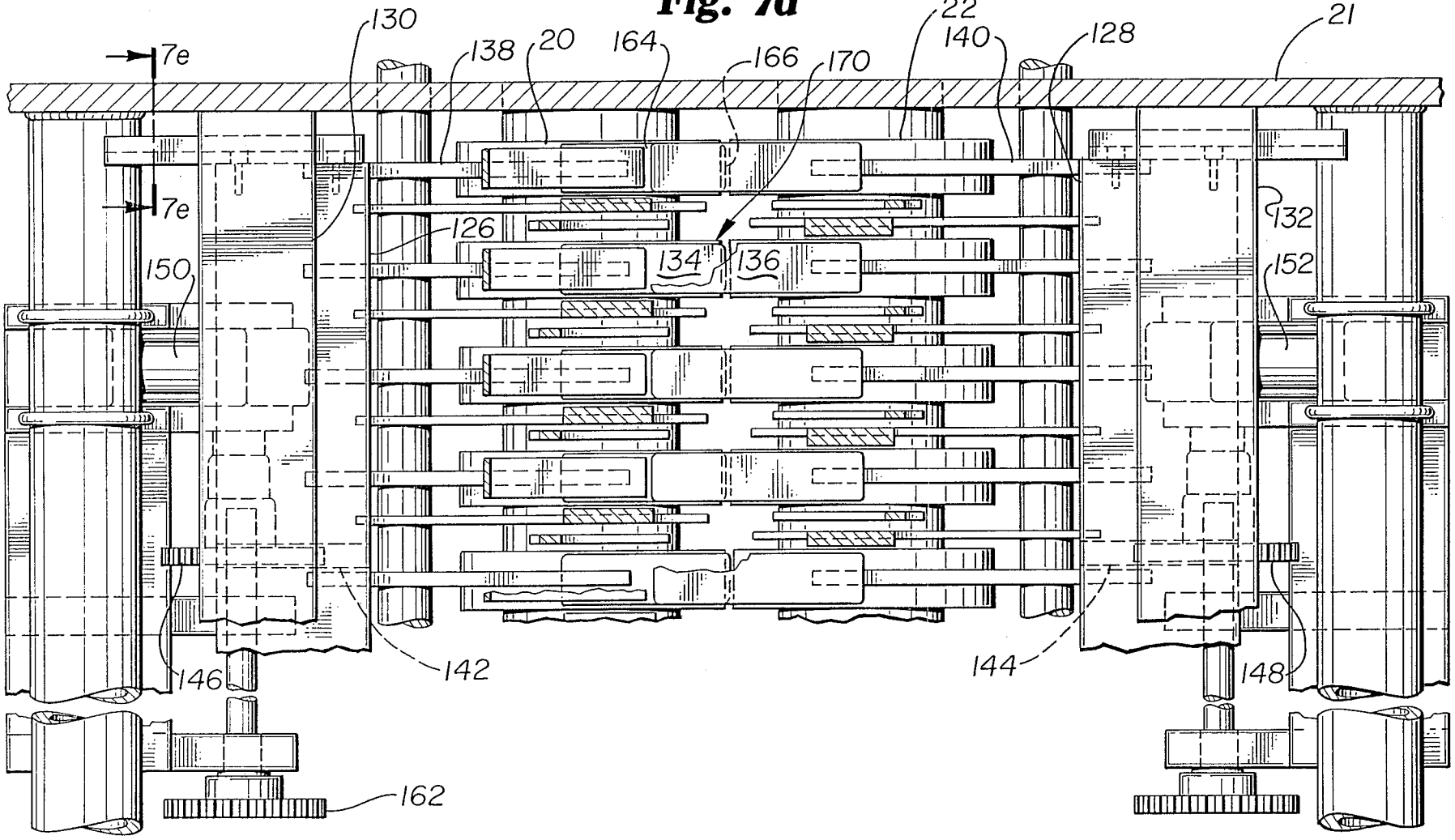
FIG. 7*d* is a bottom view along line 7*d*–7*d* of FIG. 7*c*, but omitting the interfolded products for clarity.

Referring now also to FIG. 7*a*, if the side of the stack from which layer 9 depends is the "first" side of the stack, finger 118 projects toward principal axis 5 from the first side of the stack and finger 120 projects toward principal axis 5 from the other or "second" side of the stack 8. When fingers 118, 120 are actuated, they will contact, respectively, first and second sides of mediate region 168 of layer 9. Referring now also to FIG. 7*b*, the first and second dispensing fold fingers 118, 120 preferably have a relatively flat tip portion 134, 136. Tip portions 134, 136 are mounted to supports 126, 128 by extension portions 138, 140. Finger mounts 126, 128 each have a rack gear 142, 144 and may have a linear bearing (not shown) between finger mounts 126, 128 and cross members 130, 132. Rack gears 142, 144 are driven by pinion gears 146, 148. Pinion gears 146, 148 are preferably driven by rotary air cylinders 150, 152, of the type as manufactured by Rota-Cyl Corp. at P.O. Box 98, 97 Main Street, Schwenksville, Pa. 19473. Cylinders 150, 152 are supported by U-clamps 154, secured to transverse tubes 156, 158. It is to be understood that cylinders 150, 152 may alternatively be linear air cylinders to drive finger mounts 126, 128 with respect to cross members 130, 132. Pinion gear 146 is connected by a rigid shaft 160 to a follower pinion gear 162. It is to be understood that gears 146 and 162 are preferably spaced to approximately trifurcate the transverse dimension of machine 62. Follower gear 162 is to be understood as engaging a rack gear (not shown) to avoid misalignment of finger mount 126 and fingers 118. More specifically, gears 146, 162 cooperating with their respective rack gears will maintain finger mount 126 parallel to the transverse dimension of machine 62 as mount 126 moves with respect to member 130.

Referring now more particularly to FIGS. *7c* and *7d*, actuator 150 moves first dispensing fold fingers 118 to an actuated position 164 to begin to form tail 9 into a dispensing fold. At this time, the leading edge 166 of tip portion 134 is in contact with a mediate portion or region 168 of the depending layer 9. By "mediate portion or region" is meant any position or portion between: (i) the line of contact 3 between layer 9 and the adjacent layer on stack support 48 and (ii) the free end or edge 7 of layer 9.

Next, second dispensing fold fingers 120 are advanced to an actuated position 170, as shown in FIGS. *7c* and *7d*. Actuated position 170 is subjacent or below the first dispensing fold fingers 118 in actuated position 164, overlapping to fold the depending layer against the first dispensing fold fingers 118 as shown in FIG. *7c*.

As may be seen in FIG. 8, while carriage 14 holds clip 10 in position 98, ejector 100 moves clip 10 to reject gate 96. Normally gate 96 remains stationary. In the event a defective clip is formed, it may be rejected immediately after separation from the package building stack by pivoting gate 96 to position 106. By locating reject gate at the separate outlet station 98, further processing of defective clips is eliminated, thus improving machine efficiency. Actuator 100 may be a bi-directional air cylinder or other conventional actuator. Retention or initial count fingers 28 are then retracted to a deactuated position 101 (as shown in FIG. 8).

Figure 9:
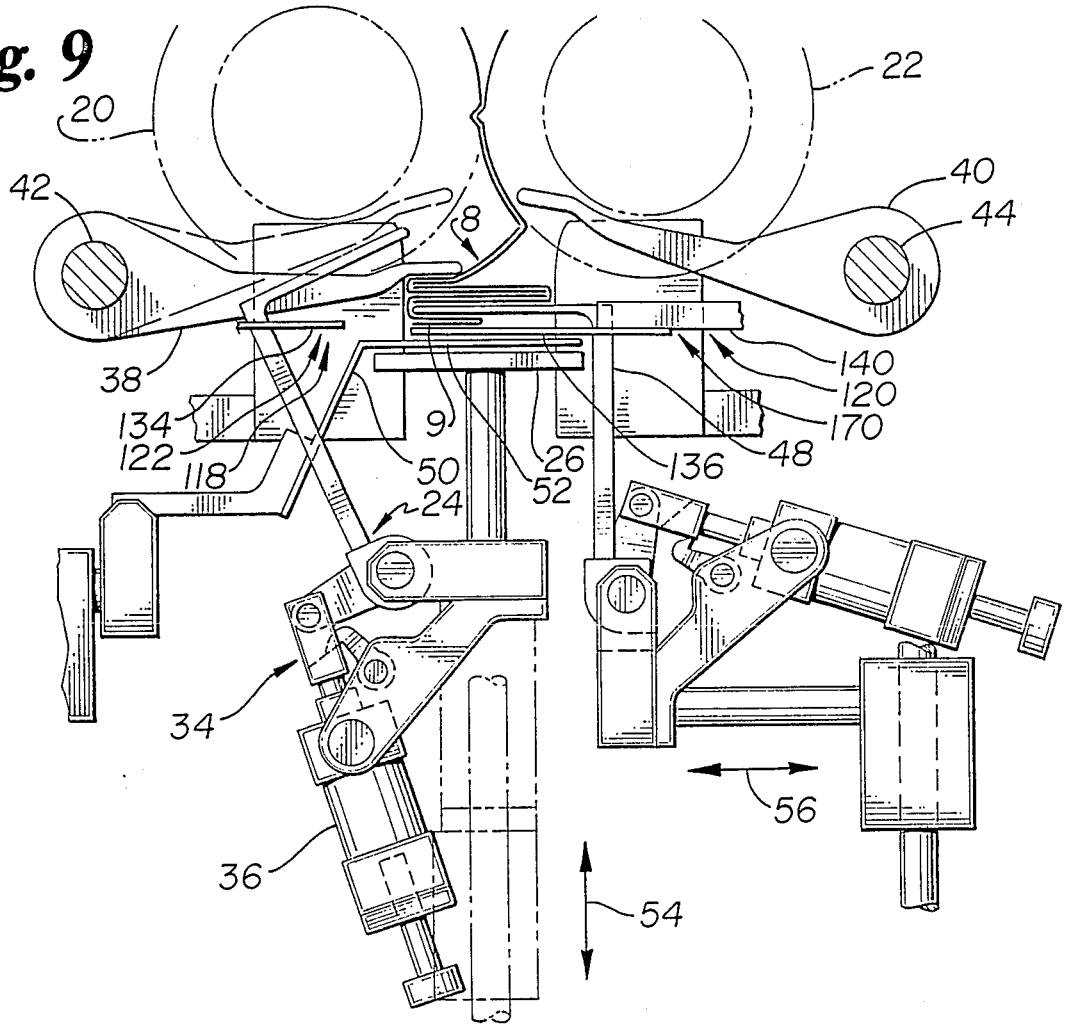
FIG. 9 illustrates the elements of the machine still further in the cycle where the package build fingers become operative.
Figure 10:
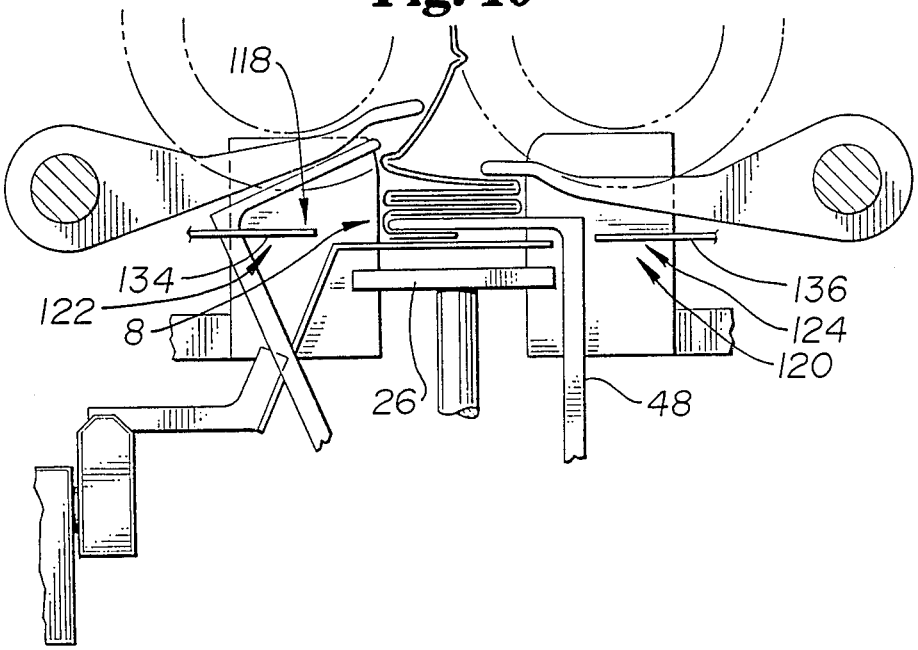
FIG. 10 illustrates elements of the machine still further in the cycle where stack building continues on the second count fingers.

Referring now to FIGS. 9 and 10, the stack 8 continues to build from folding rolls 20, 22 and packer fingers 38, 40. As stack or package building continues, second count fingers 48 continue to move relatively slowly downward in the −Y direction such that the topmost layer of stack 8 is properly positioned with respect to packer fingers 38, 40. During this process, carriages 16 and 18 move together. Table 26 is preferably held stationary with package building advancing towards it. Alternatively table 26 may be positioned to the package building station 95, moving relatively slowly in the −Y direction as stack building continues.

Referring now more particularly to FIG. 9, first dispensing fold fingers 118 are retracted, and tail 9 having a dispensing fold formed therein is supported by second dispensing fold fingers 120. Referring now also to FIG. 10, the package build fingers 50 are advanced in the +X direction lateral to principal axis 5 of stack 8 to support tail 9 (which is now a folded depending layer) and second dispensing fold fingers 120 are retracted to position 124 clear of the interfolding process stack 8.

Figure 11:
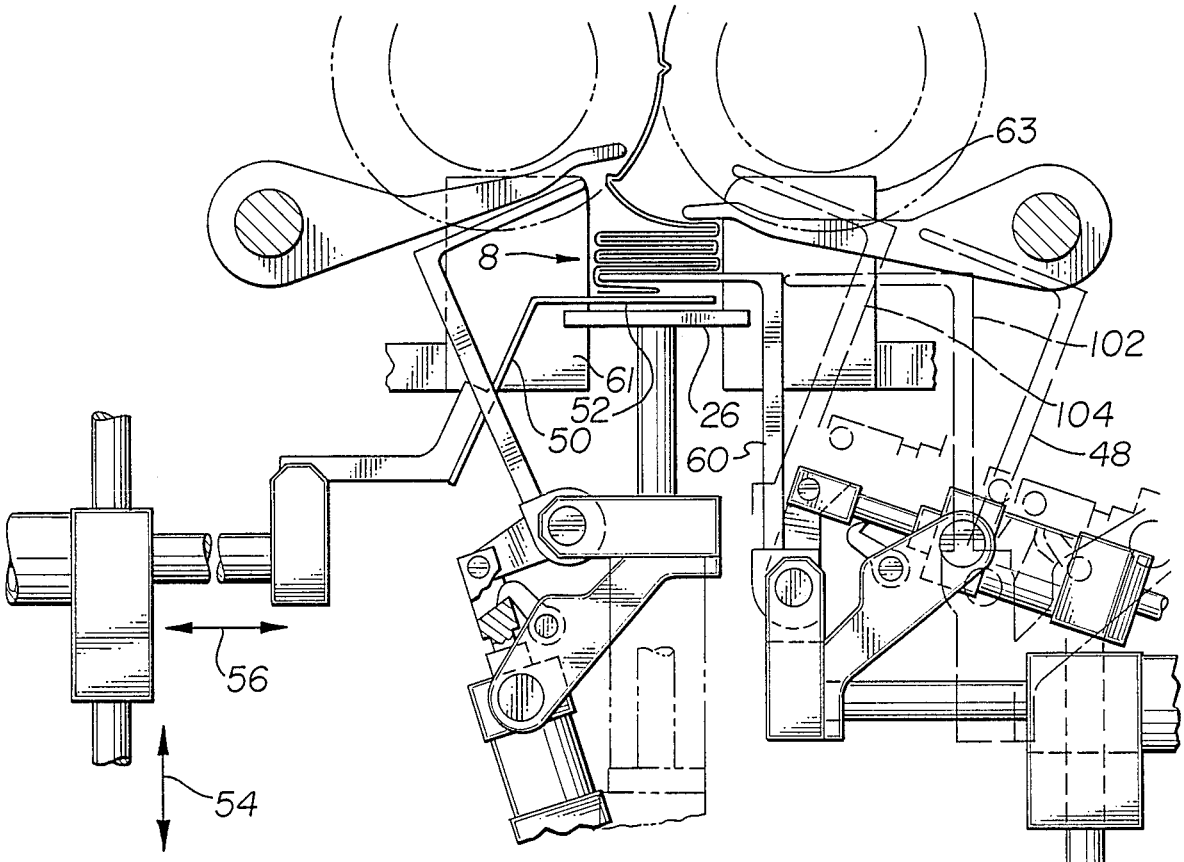
FIG. 11 illustrates elements of the machine still further in the cycle where the second count fingers are retracted and reset.

Referring now to FIG. 11, package building fingers 50 assume support of stack 8 including the depending layer after a dispensing fold is formed therein at portion 52, when second count fingers 48 are retracted from position 60 to position 102. After count fingers 48 are clear of stack 8, they are reset to a deactuated position 104, ready to be actuated for a successive clip separation cycle. Meanwhile, package build fingers 50 are advanced in the −Y direction parallel to the stack principal axis 5 as package building continues.

Figure 12:
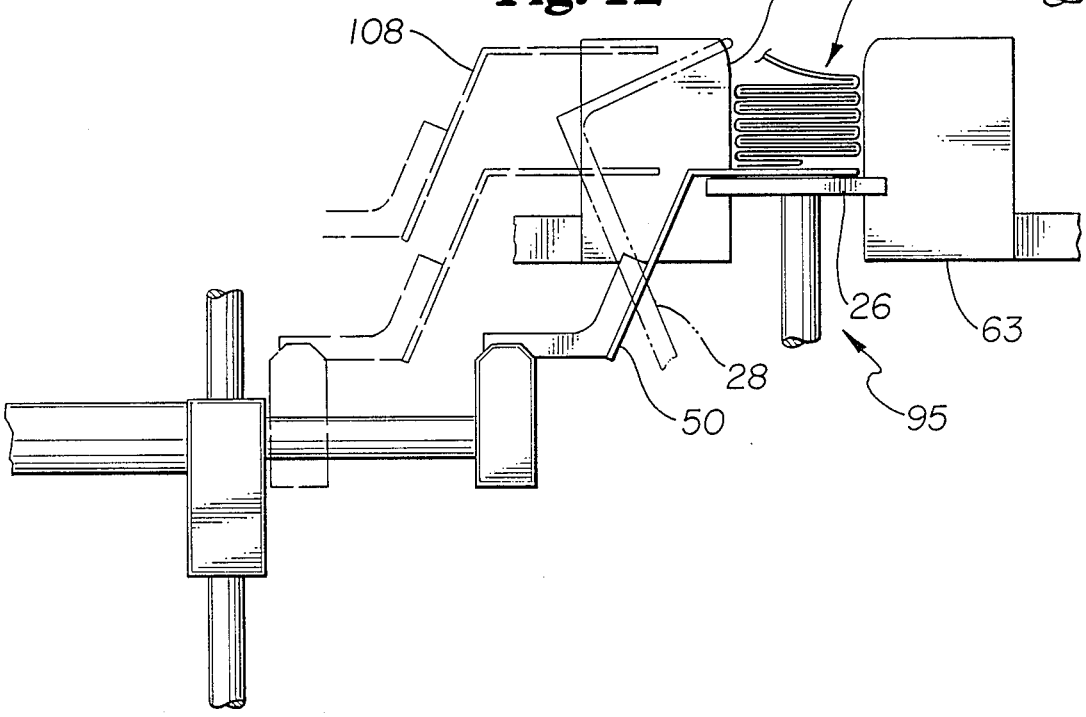
FIG. 12 illustrates elements of the machine still further in the cycle where the package build fingers are retracted, transferring stack support to the elevator table.

Referring now to FIG. 12, once table 26 has returned to the package building station 95, package build fingers 50 are retracted in the −X direction and translated in the +Y direction stopping at a deactuated or ready position 108. Once package build fingers 50 are retracted, stack 8 is supported by table 26. Guides 61 prevent movement of stack 8 in the −X direction while fingers 50 are retracted. It is to be understood that table 26 may be positioned at the lowermost region of package building station 95 or may be moved slowly downward at a rate equal to the build rate of the stack in the −Y direction (along the stack principal axis 5) in a manner similar to that described for platform 48 during continued stack building. After a predetermined number of layers have been interfolded into stack 8, the clip separation cycle is repeated starting with the unlatching of the first count fingers 28. The separated clip with a dispensing fold formed in an end sheet thereof is subsequently inserted into an inverted carton such that when the carton and clip are returned to an upright position, the dispensing fold is accessible to a person seeking to withdraw the first sheet from the carton, as shown in FIG. 1.

The invention is not to be taken as to be limited to all of the details of the specification hereof as variations and modifications may be made without departing from the spirit or scope of the invention.

What is claimed is:

1. A method of forming a dispensing fold for a clip of a predetermined number of interfolded sheets from a continuously building interfolding process stack comprising the steps of:

a. continuously interfolding and supporting a plurality of individual sheets on a stack supporting means at a package building station to form an interfolding process stack along a principal axis with one layer of the interfolded sheets depending freely from the bottom of the stack below the stack supporting means;

b. advancing a first dispensing fold finger lateral to the principal axis to an actuated position wherein a leading edge of the first dispensing fold finger is in contact with a mediate portion of the depending layer; and c. advancing a second dispensing fold finger lateral to the principal axis to an actuated position overlapping and subjacent the first dispensing fold finger in its actuated position such that the depending layer is folded against the first dispensing fold finger.

2. The method of claim 1 further comprising the steps of:

d. retracting the first dispensing fold finger to a deactuated position clear of the interfolding process stack;

e. advancing a package build finger to support the folded depending layer; and f. retracting the second dispensing fold finger to a deactuated position clear of the interfolding process stack.

3. The method of claim 2 further comprising the step of:

g. inserting a clip having a sheet with a dispensing fold formed therein into an inverted carton such that when the carton and clip are returned to an upright position the dispensing fold is accessible to a person seeking to withdraw a first sheet from the carton.

4. The method of claim 2 wherein the package build finger is advanced in a direction lateral to the principal axis of the stack.

5. The method of claim 4 wherein the package build finger is further advanced in a direction parallel to the stack principal axis.

6. Apparatus for forming a dispensing fold in one sheet of a stack of interfolded laminar sheets comprising:

a. slack supporting means for supporting a stack of laminar sheets during an interfolding process along a principal axis such that the lowermost sheet of the stack has a layer depending freely below the stack supporting means;

b. first dispensing fold finger means projecting in a first direction transverse to the principal axis and movable between an actuated and a deactuated position for contacting a first side of a mediate region of the depending layer in the actuated position and for providing clearance to the depending layer in the deactuated position; and c. second dispensing fold finger means projecting in a second direction generally opposite to the first direction and movable between an actuated and a deactuated position for contacting a second side of the mediate region of the depending layer in the actuated position and for providing clearance to the depending layer in the deactuated position;

such that the depending layer is folded in the mediate region when the first and second dispensing fold fingers are moved to their respective actuated positions.

7. The apparatus of claim 6 wherein the first and second dispensing fold fingers are each movable in a direction generally perpendicular to the stack principal axis.

8. The apparatus of claim 6 wherein the stack supporting means comprises a platform count finger.

9. The apparatus of claim 6 further comprising:

d. package build finger means for supporting the depending layer after a dispensing fold is formed therein.

10. The apparatus of claim 6 wherein the first and second dispensing fold fingers are longitudinally offset from each other along the stack principal axis.

11. The apparatus of claim 10 wherein the first dispensing fold finger is intermediate the stack supporting means and the second dispensing fold finger when the first and second dispensing fold fingers are in their respective actuated positions.

12. The apparatus of claim 11 wherein the layer depends from a first side of the stack and the first dispensing fold finger projects toward the principal axis from the first side of the stack.

13. The apparatus of claim 12 wherein the stack has a second side opposite the first side and the second dispensing fold finger projects toward the principal axis from the second side of the stack.

14. A dispensing fold forming improvement for apparatus of the type having an interfolding table for supporting continuous building of a stack of interfolded laminar products, and a platform count finger selectively interposable above the table after a predetermined number of laminar products have been interfolded into the stack for supporting the continued building of the interfolded laminar products into a new stack with a layer of the lowermost laminar product depending freely from the platform count finger when the interfolding table is moved away from the platform count finger, the improvement in combination therewith comprising:

first and second dispensing fold finger means i. extending transversely towards and longitudinally offset from each other, ii. selectively positionable below the platform count finger, and iii. transversely movable to engage opposite sides of the depending layer at a mediate region thereof for forming a dispensing fold therein.

* * * * *